United States Patent [19]

Bridges

[11] 4,293,071

[45] Oct. 6, 1981

[54] SLANT STACKING TRAY SYSTEM

[75] Inventor: John A. Bridges, Nashville, Tenn.

[73] Assignee: Aladdin Industries, Incorporated, Nashville, Tenn.

[21] Appl. No.: 848,763

[22] Filed: Nov. 4, 1977

Related U.S. Application Data

[63] Continuation of Ser. No. 704,357, Jul. 12, 1976, abandoned.

[51] Int. Cl.[3] ..... B65D 21/02

[52] U.S. Cl. ..... 206/503; 211/133; 211/188

[58] Field of Search ..... 206/503, 504; 211/133, 211/188, 194

[56] References Cited

U.S. PATENT DOCUMENTS

| | | | |
|---|---|---|---|
| 266,562 | 10/1882 | Walker | 211/188 |
| 2,560,761 | 7/1951 | Fergusion | 206/518 |
| 3,685,687 | 8/1972 | Eckdahl | 206/504 |

FOREIGN PATENT DOCUMENTS

| | | | |
|---|---|---|---|
| 1179502 | 10/1964 | Fed. Rep. of Germany | 211/133 |
| 399683 | 3/1966 | Switzerland | 211/133 |

*Primary Examiner*—George E. Lowrance

[57] ABSTRACT

Trays for holding prepared food are provided with an element extending from the upper surface of each tray which engages the lower surface of another tray in a stack and are dimensioned so that the bottom of each tray when in the stack is at an angle to the horizontal.

6 Claims, 10 Drawing Figures

SLANT STACKING TRAY SYSTEM

This is a continuation of application Ser. No. 704,357, filed July 12, 1976, now abandoned.

BACKGROUND OF THE INVENTION

The invention relates generally to articles for food service. More specifically it relates to improvements in tray stacking systems for use in the service of food to numbers of people.

There are a number of United States patents which disclose various stacking tray systems for use in the distribution and service of prepared food. Such systems are disclosed, for instance, in U.S. Pat. Nos. 3,532,247, 3,754,640, 3,799,143 and 3,802,539.

The advantages of stacking tray systems can be enhanced and added to beyond those shown in the above cited patents by the provision of means whereby the height of a stack of trays holding food for service can be reduced.

Therefore it is an object of this invention to provide a novel stacking tray system which permits a greater number of trays to be stacked with a stack height which is less than that of the prior art.

It is another object of this invention to provide a novel stacking tray system which is relatively economical to make and simple in construction, but is capable of holding a wide variety of food items for service.

It is a still further object of this invention to provide a novel tray capable of holding a wide variety of items for food service but which is relatively compact and capable of being stacked for transportation and storage purposes.

Still another object of this invention is to provide a novel stacking tray system which, while holding food for service at locations remote for a food preparation area, may be easily transported.

BRIEF SUMMARY OF THE INVENTION

The foregoing and other objects of the invention are achieved by providing trays which can be stacked so that their upper surfaces lie at an angle to the horizontal when stacked.

BRIEF DESCRIPTION OF THE DRAWINGS

The invention itself is set forth in the claims appended hereto and forming a part of this specification while an understanding of various embodiments can be had by reference to the detailed description taken in conjunction with the drawing in which:

DETAILED DESCRIPTION

Figure 1:
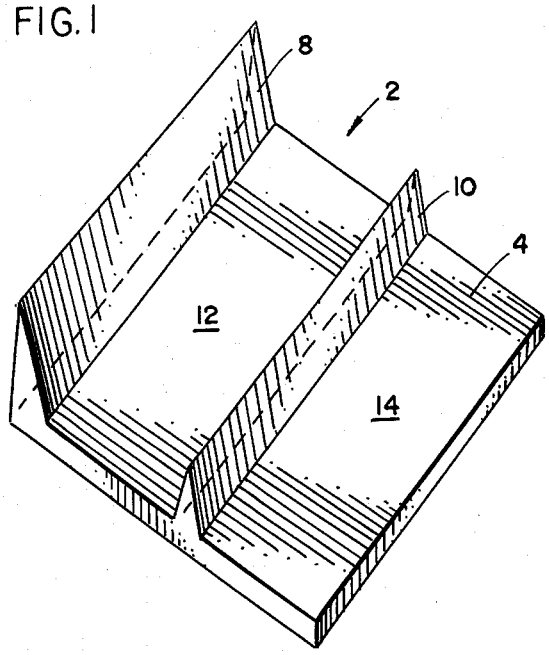
FIG. 1 is a perspective illustration of an embodiment of the invention.
Figure 2:
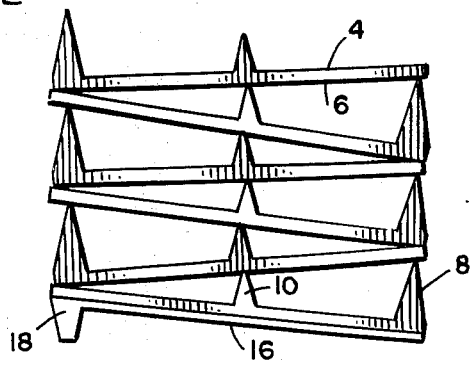
FIG. 2 is a side view of a number of trays as shown in FIG. 1 arranged in a stack.
Figure 3:
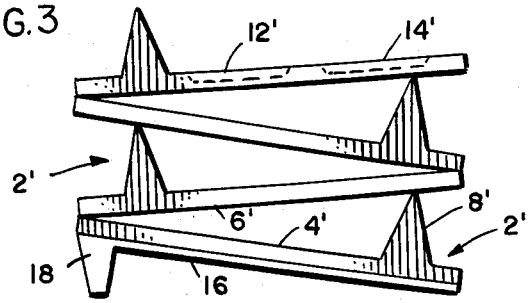
FIG. 3 is a side view of a number of trays constituting another embodiment of the invention arranged in a stack.

FIGS. 1–3 illustrate in essentially diagrammatic form two embodiments of the invention. Thus, as shown in FIGS. 1 and 2, a plurality of trays 2 are each provided with an upper surface 4 and a lower surface 6. It is contemplated that the upper surface 4, on which the food portions are received, may be configured in a number of different ways as desired by a designer to accommodate plates, cups, food items such as fruit, sandwiches, beverages or the like. Such configurations may recognize both utilitarian and aesthetic considerations. Other illustrated embodiments which will be described hereinafter will serve as examples of this aspect of the invention.

In accordance with the invention, extending upwardly from the upper surface 4 of each tray are one or more supporting or spacing elements 8 and 10 for the purpose of engaging the lower surface 6 of the tray above when a number of trays are arranged in a stack. As will be seen hereinafter, the spacing elements may be formed in a number of different ways and in addition to performing the spacing function, as will be described, they may also serve to divide the upper surface into compartments or sections indicated generally at 12 and 14 as food, beverage, condiment or utensil holding areas.

Referring now to FIG. 2, it can be seen how a tray incorporating the concepts of FIG. 1 may be stacked to provide a tray stack containing a number of trays occupying less vertical space than would be required in a stack of trays containing the same number of trays constructed in accordance with the teachings of the prior art.

In FIG. 2 a stack carrier or base 16 is provided at the bottom of the stack, and as may be seen is constructed with a means, in this case a foot 18, at one end so that the upper surface of the base is at an angle to the horizontal. Obviously the design of the base or carrier 16 may be varied in any number of ways. For instance, it could be formed as a wedge shaped element and the design and specific location of the foot 18, if such is used, need not be that shown in the drawing.

A first tray 2 is placed on the base 16 and when so placed its upper surface 4 is inclined to the horizontal at the angle of the base. Food has been previously placed on the tray 2 and whatever else is desired to be served to an individual consumer can have been placed previously in the sections or compartments 12 and 14. An additional tray 2 is placed on top of the first tray with its spacing element or elements 8 and/or 10 at the opposite side of the stack from that of the first tray so that its upper surface 4 is inclined to the horizontal in the direction opposite to that of the tray beneath.

Succeeding trays 2 are then stacked alternating the directions of incline until the stack is complete. Each spacing element extending from the upper surface of the tray below contacts the lower surface of the tray above as shown so that the upper surface of the trays alternate in the direction of the angle of incline to the horizontal. As will be described hereinafter, when a desired number of trays have been stacked a cover may be provided over the top tray and the stack carrier or base 16 provided with straps or other suitable fastening means to permit the stack of trays to be manually handled and transported from a place of preparation to a place of service.

FIG. 3 shows another embodiment of invention in order to illustrate the point that the number of spacing elements and their precise location to permit "slant stacking" is not critical. Thus in this embodiment there is only one spacing element 8' extending from the upper surface 4' of a tray 2' and engaging a lower surface of the tray 2' above it. This embodiment also illustrates that food, dish, utensil or condiment holding areas 12' or 14' may be constituted by recesses in the tray formed, for instance, by molding them into the body of the tray.

The remaining figures illustrate how preferred embodiments may be designed to reflect both utilitarian and aesthetic considerations. Each of the trays illustrated in these figures may be formed by molding a suitable plastic material to form trays having such qualities as: sufficient mechanical strength to be self supporting; heat resistant to permit washing; durability; and a hard surface to resist scarring by knives and forks. Alternatively, the trays may be formed of a plastic, paper or fiberboard material so as to be disposable.

Figure 4:
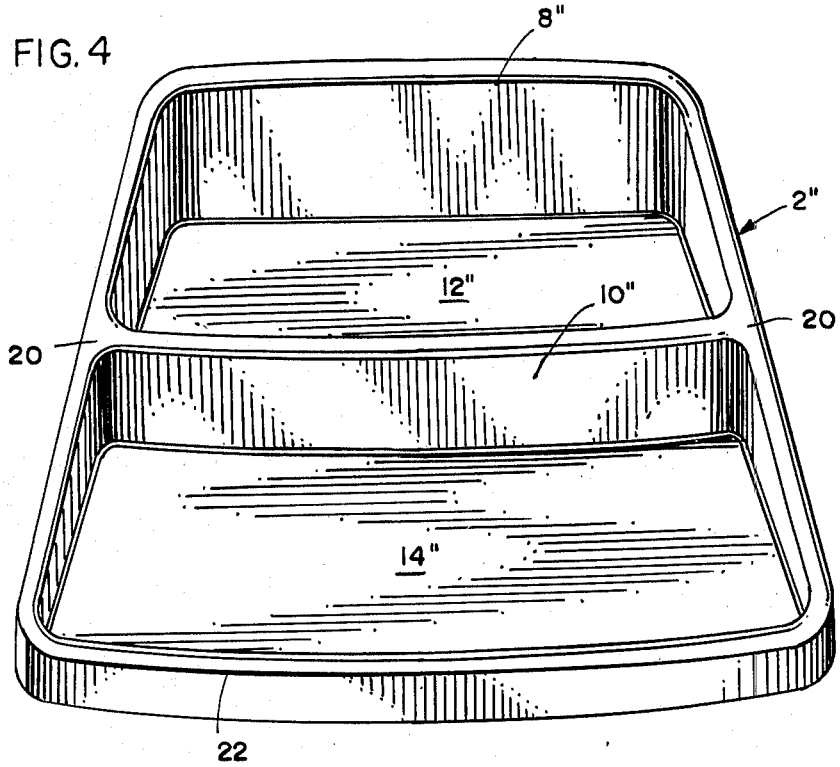
FIG. 4 is a perspective illustration of a tray constituting still another embodiment of the invention.
Figure 5:
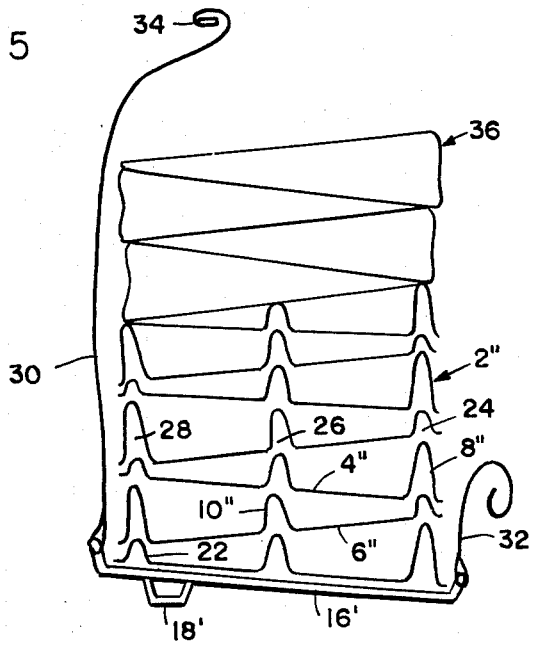
FIG. 5 is a side view, partially in section, of a number of trays as shown in FIG. 4 arranged in a stack.

In FIGS. 4 and 5 the tray 2" is formed with its spacers 8" and 10" integral with raised side edges 20 and front edge 22, thereby constituting side rims and a divider so that the upper surface 4" is divided into two areas 12" and 14". The side edges and divider function to prevent food or other articles from slipping from the tray as it is transported or used.

As may be seen in FIG. 5, the spacers 8" and 10" and front edge 22 of a tray under another tray can engage in matching grooves or spaces 24, 26 and 28 formed in the bottom surface 6" of the tray above. Such interengagement is effective to render a stack of trays in accordance with the invention a more stable structure.

In order to transport a stack of trays the base 16" may be provided with carrying straps 30 and 32, each attached at one end to the base and capable of being belted together by any suitable clasp or buckle 34. A stack may be completed by using one tray 36 as a cover so that the articles on the tray are enclosed by the bottom 6", sides 20', spacer 8' and front edge 22, and are thereby protected from such dust and dirt as may be present in their environment.

Figure 6:
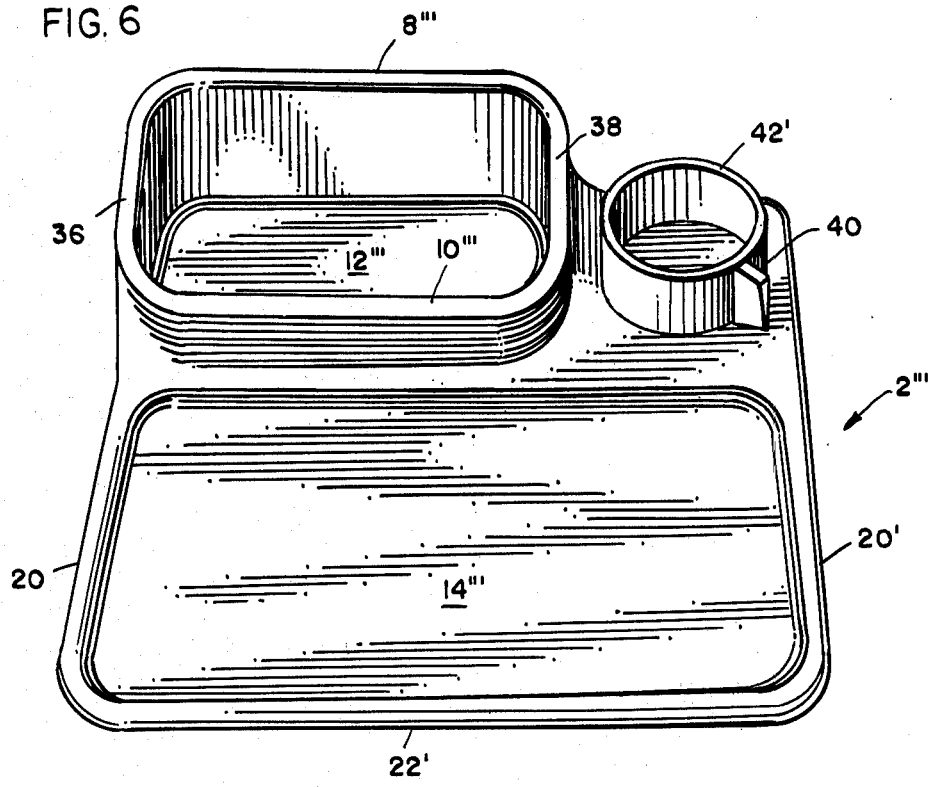
FIG. 6 is a perspective illustration of another embodiment of the invention.
Figure 7:
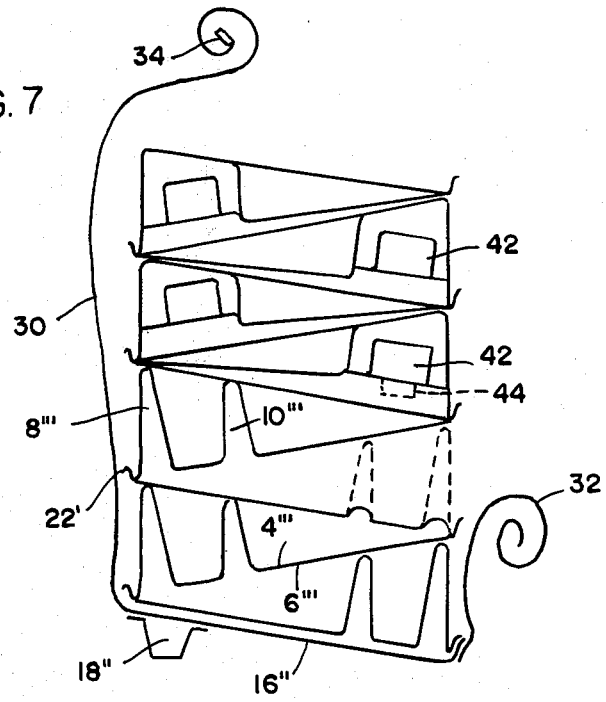
FIG. 7 is a side view, partially in section, of a number of trays as shown in FIG. 6 arranged in a stack.

In the embodiment of FIGS. 6 and 7 the tray 2''' has a first item holding area 12''' formed by spacing elements 8''' and 10''' and side walls 36 and 38 sloping from element 8''' toward element 10'''. The raised side edges 20' start at the element 10''' and with the raised front edge 22' form a second item holding area 14'''. As may be seen, the area 12''' occupies less than the width of the tray and a flat space 40 may accommodate a cup or other container 42, the bottom of which can be received in a recess 44 formed in the upper surface 4'''.

Figure 8:
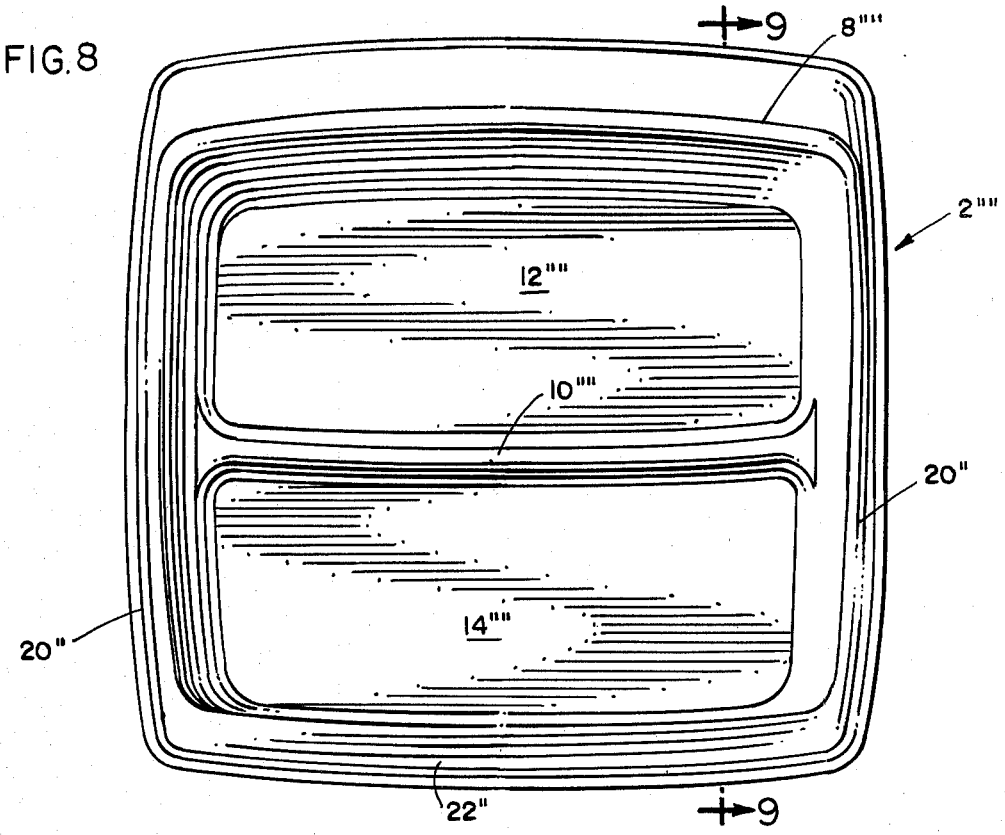
FIG. 8 is a top view of still another embodiment of the invention.
Figure 9:
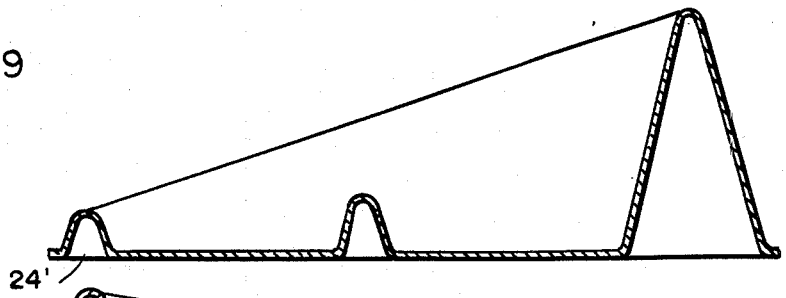
FIG. 9 is a view along the line 9—9 of FIG. 8.
Figure 10:
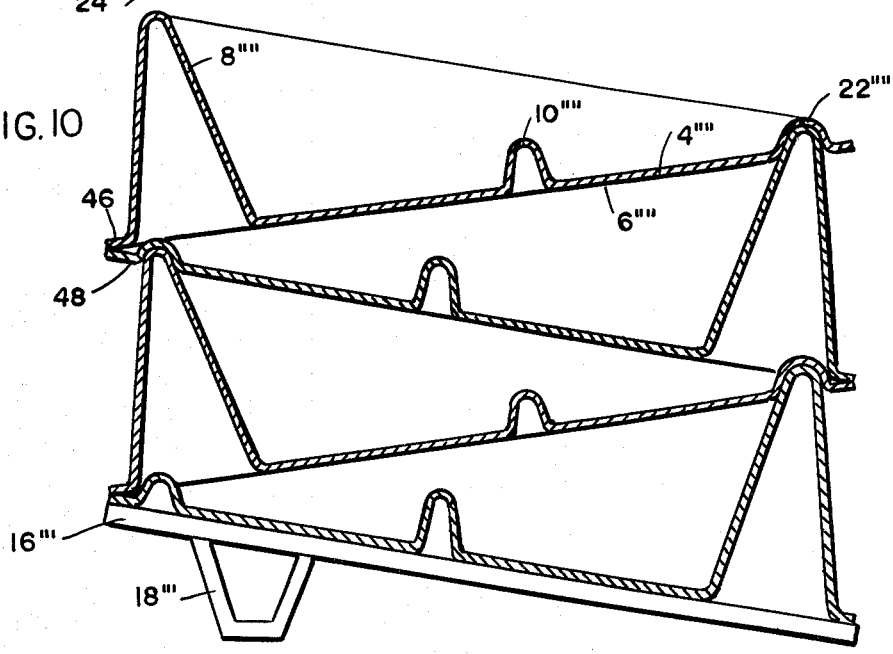
FIG. 10 is a view in section of a stack of trays as shown in FIG. 8.

The embodiment of FIGS. 8 to 10 is a variation of the embodiment of FIGS. 4 and 5 wherein the elements of each tray are essentially the same but have been configured somewhat differently with the spacer 8''', element 10'''', raised side edges 20" and front edge 22" providing two holding areas 12'''' and 14''''. When stacked, the element 8'''' of a lower tray 2'''' engages in a recess 24' provided in bottom surface 6'''' of an upper tray while a ledge 46 of the upper tray contacts a ledge 48 of the lower tray.

Various embodiments and design variations have been shown or suggested. Other variations are possible without departing from the spirit of the invention, and it is intended by the claims appended hereto to cover all variations as come within their scope.

What is claimed as new and desired to be secured by Letters Patent is:

1. A stack of trays, each tray having a tray body with a continuous upper surface for holding food holding containers and a lower surface, a stacking element extending from said upper surface above every other portion of said upper surface and above any food holding containers which may be placed thereon and wherein each tray positioned relative to each other in the stack so that a stacking element on a tray under another tray engages a portion of the lower surface of the tray above while another portion of the upper surface of a tray under another tray engages still another portion of the lower surface of the tray above to cause the body of each tray to be at an angle to the horizontal, said upper surface of each tray provided with at least two discrete item holding areas.

2. A stack of trays, each tray having a tray body with a continuous upper surface for holding food holding containers and a lower surface, a stacking element extending from said upper surface above every other portion of said upper surface and above any food holding containers which may be placed thereon and wherein each tray positioned relative to each other in the stack so that a stacking element on a tray under another tray engages a portion of the lower surface of the tray above while another portion of the upper surface of a tray under another tray engages still another portion of the lower surface of the tray above to cause the body of each tray to be at an angle to the horizontal, said upper surface of each tray having another element extending above its upper surface dividing said upper surface into two discrete item holding areas.

3. A stack of trays, each tray having a tray body with a continuous upper surface for holding food holding containers and a lower surface, a stacking element extending from said upper surface above every other portion of said upper surface and above any food holding containers which may be placed thereon and wherein each tray positioned relative to each other in the stack so that a stacking element on a tray under another tray engages a portion of the lower surface of the tray above while another portion of the upper surface of a tray under another tray engages still another portion of the lower surface of the tray above to cause the body of each tray to be at an angle to the horizontal, said stacking elements extend completely around the periphery of each of said trays and their height above said upper surface increases gradually from said tray flat portion to an opposite side thereof, said stack of trays including a divider extending up from and across said upper surface to divide said upper surface into discrete article holding areas on each of said trays.

4. A stack of trays, each tray having a tray body with a continuous upper surface for holding food holding containers and a lower surface, a stacking element extending from said upper surface above every other portion of said upper surface and above any food holding containers which may be placed thereon and wherein each tray positioned relative to each other in the stack so that a stacking element on a tray under another tray engages a portion of the lower surface of the tray above while another portion of the upper surface of a tray under another tray engages still another portion of the lower surface of the tray above to cause the body of each tray to be at angle to the horizontal, said stacking elements extend over a portion of one side of said flat portions of said trays, said stacking elements each comprise an upwardly extending pair of walls, one higher than the other, connected by sloping side walls to enclose an area at one side of each of said trays.

5. A tray comprising a flat portion having a continuous upper surface for holding food holding containers and a lower surface, a stacking element extending from said upper surface above every other portion of said upper surface and any food holding containers which might be provided on said upper surface whereby said tray when used alone provides a horizontal surface for receiving articles thereon, and when stacked with other substantially similar said stacking element engages the bottom surface of a tray above it to cause the tray above to be at an angle to the horizontal, said stacking element extends completely around the periphery of said tray, and its height above said upper surface increases gradually from one side of said flat portion to the opposite side, said tray including a divider extending up from and across said upper surface to divide said upper surface into discrete artcle holding areas.

6. A tray comprising a flat portion having a continuous upper surface for holding food holding containers and a lower surface, a stacking element extending from said upper surface above every other portion of said upper surface and any food holding containers which might be provided on said upper surface whereby said tray when used alone provides a horizontal surface for receiving articles thereon, and when stacked with other substantially similar said stacking element engages the bottom surface of a tray above it to cause the tray above to be at an angle to the horizontal, said stacking element extends over a portion of one side of said flat portion, said stacking element comprises an upwardly extending pair of walls, one higher than the other, connected by sloping side walls to enclose an area at one side of said tray.

* * * * *